US005881349A

United States Patent [19]

Nanataki et al.

[11] Patent Number: 5,881,349

[45] Date of Patent: Mar. 9, 1999

[54] IMAGE INDUCTION HEATING APPARATUS

[75] Inventors: Hideo Nanataki, Tokyo; Hiroki Kisu, Fujisawa; Atsuyoshi Abe, Yokohama; Tetsuya Sano, Numazu, all of Japan

[73] Assignee: Canon Kabushiki Kaisha, Tokyo, Japan

[21] Appl. No.: 891,976

[22] Filed: Jul. 11, 1997

Related U.S. Application Data

[63] Continuation of Ser. No. 678,980, Jul. 12, 1996, abandoned.

[30] Foreign Application Priority Data

Jul. 12, 1995 [JP] Japan ..... 7-176121

[51] Int. Cl.[6] ..... G03A 15/70

[52] U.S. Cl. ..... 399/328; 399/335; 219/216; 219/619

[58] Field of Search ..... 399/328, 330, 399/335; 219/216, 619, 635, 652

[56] References Cited

U.S. PATENT DOCUMENTS

| | | | |
|---|---|---|---|
| 4,570,044 | 2/1986 | Kobayashi et al. | 219/619 |
| 4,912,514 | 3/1990 | Mitzutani . | |
| 5,153,654 | 10/1992 | Yuminamochi et al. . | |
| 5,177,549 | 1/1993 | Ohtsuka et al. . | |
| 5,278,618 | 1/1994 | Mitani et al. . | |
| 5,331,385 | 7/1994 | Ohtsuka et al. . | |
| 5,438,398 | 8/1995 | Tanigawa et al. . | |
| 5,526,103 | 6/1996 | Kato et al. | 399/328 |
| 5,552,582 | 9/1996 | Abe et al. | 219/619 |
| 5,568,240 | 10/1996 | Ontsuka | 399/335 |

FOREIGN PATENT DOCUMENTS

| | | |
|---|---|---|
| 0 649 072 | 4/1995 | European Pat. Off. . |
| 51-109737 | 9/1976 | Japan . |

OTHER PUBLICATIONS

Patent Abstracts of Japan, vol. 11, No. 383 (P–646), 15 Dec. 1987 & JP 62–150371 (Alps Electric Co Ltd), 4 Jul. 1987.

*Primary Examiner*—Joan H. Pendegrass
*Attorney, Agent, or Firm*—Fitzpatrick, Cella, Harper & Scinto

[57] ABSTRACT

An image heating apparatus is provided with:

a moving member having an electrically conductive layer and arranged to move together with a recording medium, an exciting coil for generating a magnetic flux, wherein the magnetic flux generated by the exciting coil generates eddy currents in the moving member and the eddy currents make the moving member generate heat, wherein the heat of the moving member heats an image on the recording medium, a magnetic member for guiding the magnetic flux generated by the exciting coil, wherein the moving member and the magnetic member form a substantially closed magnetic circuit, wherein an angle θ [rad] formed between a principal line of magnetic force directed from the magnetic member to the moving member and a principal line of magnetic force directed from the moving member to the magnetic member is determined to be $0<\theta<\pi$.

58 Claims, 8 Drawing Sheets

IMAGE INDUCTION HEATING APPARATUS

This application is a continuation of application Ser. No. 08/678,980, filed Jul. 12, 1996, now abandoned.

BACKGROUND OF THE INVENTION

1. Field of the Invention

The present invention relates to an image heating apparatus for effecting heating by eddy currents generated utilizing the electromagnetic induction. More particularly, this apparatus concerns a fixing device in image forming apparatus such as electrophotographic copiers, printers, and facsimile devices, or concerns an apparatus for heating an unfixed toner image formed in direct or indirect fashion on a surface of a recording medium with toner of a heat-melting resin by an appropriate image forming process means such as electrophotography, electrostatic recording, or magnetic recording to fix the toner image as a permanent fixed image on the recording medium surface.

2. Related Background Art

FIG. 12 is a drawing to explain the prior art, which is a schematic sectional view of a laser beam printer as an application of the electrophotography to printer. The operation of this apparatus will be explained.

An electrostatic latent image is formed on a photosensitive drum 11 as modulating the intensity of a laser beam from a scanner 13 according to an image information signal sent from a host computer. The intensity and irradiation spot diameter of the laser beam are properly set according to the resolution of image forming apparatus and the desired image density, and the electrostatic latent image on the photosensitive drum 11 is formed by maintaining portions irradiated by the laser beam at a light potential $V_L$ and the other portions at a dark potential $V_D$ charged by a primary charger 12. The photosensitive drum 11 rotates in the direction of the arrow, so that the electrostatic latent image is successively developed by a developing unit 14. The toner in the developing unit 14 forms a uniform toner layer on a developing sleeve 1402 while the toner height and triboelectric effect are controlled by the developing sleeve 1402, being a toner feed roller, and a developing blade 1401. The developing blade 1401 is usually one made of a metal or a resin. In the case of a resin blade being used, it is in contact with the developing sleeve 1402 under appropriate contact pressure. With rotation of the developing sleeve 1402 itself the toner layer formed on the developing sleeve 1402 comes to face to the photosensitive drum 11, and only the portions of $V_L$ are selectively developed by a voltage Vdc applied to the developing sleeve 1402 and the electric field formed by the surface potential of the photosensitive drum 11. The toner image on the photosensitive drum 11 is successively transferred onto a sheet fed from a sheet supplying device by a transfer unit 15. The transfer unit may be a corona charger as shown, or a unit of a transfer roller method in which the sheet is conveyed as applying a transfer charge to the sheet by supplying an electric current from a power supply to an electrically conductive, elastic roller. The sheet with the toner image transferred thereon is further fed to a fixing unit 10 with rotation of the photosensitive drum 11 to heat and press the toner image into a permanently fixed image.

The heat roller method as shown in FIG. 12 has widely been used heretofore for image heating apparatus typified by the heat fixing device.

The heat roller method, however, had the problem that the fixing roller has a large heat capacity to require high power for heating and a long wait time.

Thus, the following proposals have been made to directly heat the fixing roller by utilizing generation of induced current.

Japanese Utility Model Application Laid-open No. 51-109737 discloses the induction heat fixing device for inducing the electric current in the fixing roller by magnetic flux to heat it by Joule heat.

Further, Japanese Patent Publication No. 5-9027 discloses the heating technique utilizing the feature of the fixing roller being a rotating body, in such structure that an exciting coil is provided upstream of the nip in the rotating direction of the fixing roller.

In addition, U.S. Pat. No. 5,278,618 discloses an example using a fixing film of decreased heat capacity in place of the fixing roller and heating it by an exciting member near the nip.

The fixing device disclosed in Japanese Laid-open Utility Model Application No. 51-109737, however, had the drawback that radiation losses are large, because energy of alternating magnetic flux generated by the exciting coil is used for increasing the temperature of the entire fixing roller, and the density of the fixing energy is low with respect to the input energy so as to result in low efficiency.

Further, the fixing device disclosed in Japanese Patent Publication No. 5-9027 is arranged to use the magnetic flux energy in the local place, so that the radiation losses would be decreased. However, since it uses the magnetic flux penetrating the heated member, it is necessary to set a low frequency of the alternating current used for excitation, which caused the problem that the energy conversion efficiency is lowered.

U.S. Pat. No. 5,278,618 shows inclusion of the fixing film as a heated member in a part of the magnetic path, but it requires the magnetic path of very high flux density against the fixing film, because the magnetic path is limited in the nip area, which caused the problem of experiencing magnetic saturation and in turn failing to obtain sufficient efficiency.

SUMMARY OF THE INVENTION

An object of the present invention is to provide an image heating apparatus utilizing the electromagnetic induction to improve the heat generation efficiency.

Another object of the present invention is to provide an image heating apparatus in which a substantially closed magnetic circuit is formed by a moving member and a magnetic member and an angle θ [rad] formed between a principal line of magnetic force directed from the magnetic member to the moving member and a principal line of magnetic force directed from the moving member to the magnetic member is arranged to satisfy $0<\theta<\pi$.

Still another object of the present invention is to provide an image heating apparatus in which the magnetic member is of a T-shaped form when seen along a direction perpendicular to the moving direction of the moving member.

Further objects of the present invention will become apparent in the following description.

DETAILED DESCRIPTION OF THE PREFERRED EMBODIMENTS

The embodiments of the present invention will be explained with reference to the drawings.

(First Embodiment)

Figure 1:
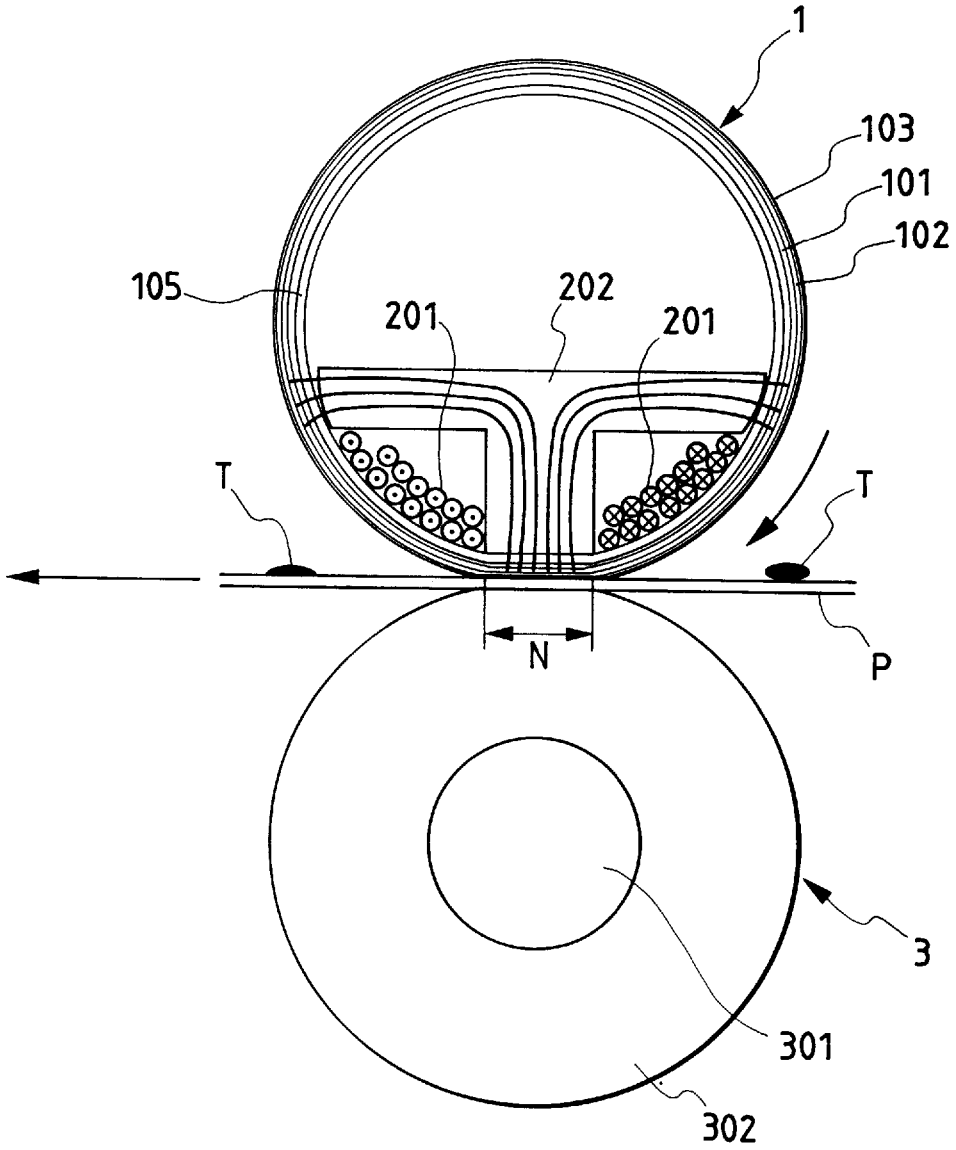
FIG. 1 is a sectional view of a fixing apparatus as an embodiment of the present invention.

FIG. 1 is a drawing to show the features of the present invention best. In FIG. 1, reference numeral 1 designates a fixing film, which is a rotary heating member as a moving member, and 105 an electrically insulating film guide not obstructing permeation of magnetic flux. The fixing film 1 rotates in the direction of the arrow under carrying stability ensured by the film guide 105. Numeral 201 denotes an exciting coil for generating the alternating magnetic flux, and 202 a core as a high-permeability member, or a magnetic member, for guiding the alternating magnetic flux generated by the exciting coil 201 in the circumferential direction of the fixing film 1 to form a substantially closed magnetic circuit. In the present embodiment the core is made of ferrite and is supported by the film guide 105.

An excitation circuit is connected to the exciting coil 201, and this excitation circuit is arranged to be capable of supplying an alternating current of 50 kHz to the exciting coil 201. Numeral 3 denotes a press roller being a rotary pressing member as a back-up member, which is made by forming a coating of silicone rubber layer 302 in the thickness of 2 mm on a core 301 so as to add elasticity and which forms the nip N with the fixing film 1. The press roller 3 also serves as a driving roller for rotation-driving the fixing film 1 in the carrying direction of recording sheet P.

Figure 3:
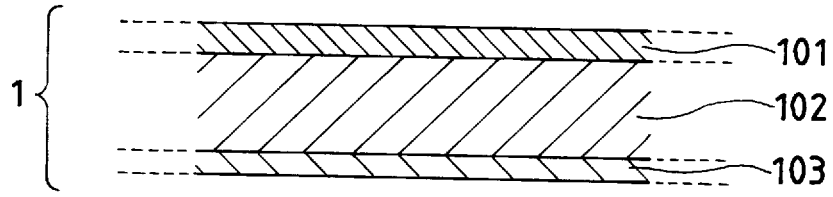
FIG. 3 is a drawing to show the layer structure of a fixing film.

The fixing film 1 will be explained in detail referring to FIG. 3. The fixing film 1 is made by covering a surface of a heating layer 101 of nickel, being an electrically conductive layer, 50 $\mu$m thick with an elastic layer 102 with silicone rubber and further covering the elastic layer 102 with a release layer 103 of a fluororesin. Without having to be limited to nickel, the heating layer 101 may be made of one from metals, metal compounds, and organic conductors being good electric conductors of $10^{-5}$ to $10^{-10}$ $\Omega$·m, and more preferably, of one from pure metals, such as iron, cobalt, and so on, indicating ferromagnetism with high permeability, or compounds thereof. As the thickness of the heating layer 101 decreases, it becomes more difficult to secure the sufficient magnetic path, which could cause the magnetic flux to leak to the outside and in turn decrease the heating energy of the heating member itself. As the heating layer 101 becomes thicker, a period of time necessary for raising the temperature tends to become longer because of the increase in the heat capacity. Accordingly, there are appropriate values for the thickness, depending upon values of the specific heat, density, permeability, and resistivity of the material used for the heating member. In the case of the present embodiment, the temperature increase rate of 3 or more °C./sec was achieved in the thickness range of 10 to 100 $\mu$m. If the hardness of the elastic layer 102 were too high, image gloss unevenness would occur, because it would fail to follow roughness of the recording medium or the toner layer. Thus, the hardness of the elastic layer 102 is preferably 60° (JIS-A) or less, and more preferably, 45° (JIS-A) or less. The thermal conductivity of the elastic layer 102 is preferably $6\times10^{-4}$ to $2\times10^{-3}$ [cal/cm·sec·deg]. If the thermal conductivity $\lambda$ were smaller than $6\times10^{-4}$ [cal/cm·sec·deg], thermal resistance would be large, so that the temperature rise would become slower in the surface layer of the fixing film 1.

The release layer 103 can be made of a material selected from not only fluororesins such as PFA, PTFE, and FEP, but also materials with good releasability and with high thermal resistance such as the silicone resin, the silicone rubber, and the fluororubber. The thickness of the release layer 103 is preferably 20 to 100 $\mu$m. If the thickness of the release layer 103 were smaller than 20 $\mu$m, there would occur the problem that some portions are formed with poor releasability because of coating unevenness of the coating film and the problem of insufficient durability. If the thickness of the release layer were over 100 $\mu$m, there would occur the problem that the thermal conduction becomes worse. Especially, when the release layer is a resin based layer, the hardness thereof becomes too high, which kills the effect of the elastic layer 102.

Figure 4:
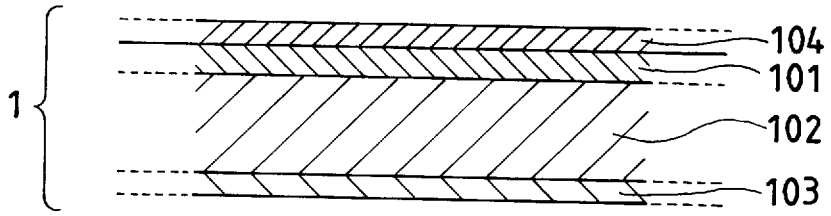
FIG. 4 is a drawing to show the layer structure of another fixing film.

Further, a heat insulating layer 104 may be provided in the layer structure of the fixing film 1, as shown in FIG. 4. Preferred materials for the heat insulating layer 104 include heat-resistant resins such as the fluororesin, polyimide resin, polyamide resin, polyamide-imide resin, PEEK resin, PES resin, PPS resin, PFA resin, PTFE resin, and FEP resin. The thickness of the heat insulating layer 104 is preferably 10 to 1000 $\mu$m. If the thickness of the heat insulating layer 104 were smaller than 10 $\mu$m, little heat insulating effect would be expected and the durability would be also insufficient. On the other hand, if the thickness were over 1000 $\mu$m, the distance would be too long between the high-permeability core 202 and the heat insulating layer 101 for the sufficient magnetic flux to reach the heating layer 101. When the heat insulating layer 104 is provided, stable heating can be done, because it can prevent the temperature rise of the exciting coil 201 and the core 202 due to the heat generated by the heating layer 101.

The exciting coil 201 needs to be one for generating the alternating magnetic flux enough for heating. For that purpose, it is necessary to set a resistance component low but an inductance component high. In the present embodiment a core wire of the exciting coil 201 is one of $\phi$1 for high frequency comprised of a bundle of fine wires, which is wound around the nip N in twelve windings.

The exciting coil 201 generates the alternating magnetic flux with the alternating current supplied from the excitation circuit, and the alternating magnetic flux is guided to the core 202 to induce eddy currents in the heating layer 101 of the fixing film 1. The eddy currents generate the Joule heat by specific resistance of the heating layer 101, which can heat the recording medium P carried to the nip N and the toner T on the recording medium P through the elastic layer 102 and release layer 103.

The present invention is characterized in that, for efficiently heating a position suitable for the fixing step, utilizing the energy of the above alternating magnetic flux, the magnetic flux is guided in the circumferential direction of the fixing film 1 so as to define the directions of lines of magnetic force without magnetic saturation of the fixing film 1 further without aerial short circuit.

Figure 2A:
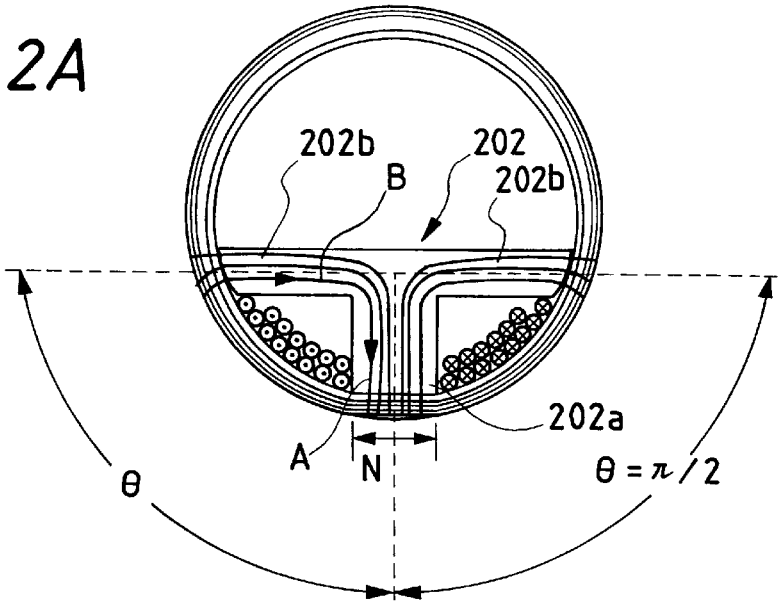
FIG. 2A is a drawing to show an embodiment of the present invention.

In the present embodiment the core 202 is formed as shown in FIG. 2A, so that an angle at a certain moment is $\pi/2$ (rad) between a direction (A) of the magnetic flux radiated from the core 202 to the fixing film 1 and a direction (B) of the magnetic flux incident from the fixing film 1 to the core 202.

Namely, the core 202 of the present embodiment is of the T-shaped form when seen along the direction perpendicular to the moving direction of the fixing film 1.

An end of a linear plate member (first portion) 202*a* in the lower part of the T shape of the core 202 is closely opposed to the fixing film 1 in the nip N, while ends of a linear plate member (second portion) 202*b* in the upper part of the T shape are closely opposed to the fixing film 1 upstream and downstream of the nip N in the moving direction of the fixing film 1. According to this arrangement, the fixing film 1 and core 202 form the substantially closed magnetic circuit.

By this arrangement, principal lines of magnetic force (at the peak of excitation current) are formed as represented by the dotted lines in the drawing, an appropriate range near the nip is heated in the fixing film 1, the energy losses due to radiation can be decreased, and the magnetic flux density contributing to heating is controlled so as to prevent generation of waste induction field.

Figure 2B:
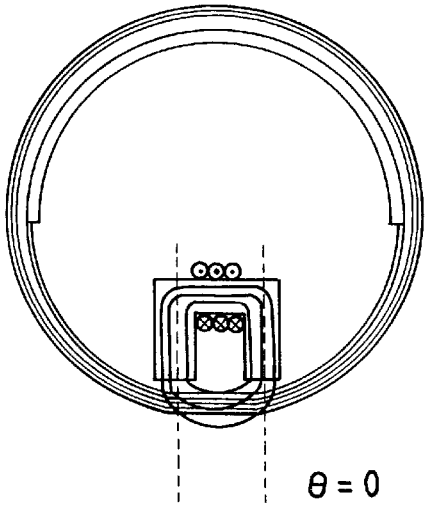
FIGS. 2B and 2C are drawings to show comparative examples.

As a comparative example, where the value of $\theta$ is 0 (rad) as shown in FIG. 2B, in the case of a thin fixing film 1 being used as a rotary heating member, magnetic saturation will occur in the fixing film 1, the magnetic path will appear in the air between cores, the heating efficiency will drop, and the heating region will become narrowed, which makes it difficult to supply the energy to the fixing step. Such tendency becomes milder as the value of $\theta$ becomes greater than $\pi/6$ (rad), thus attaining further better structure.

Figure 2C:
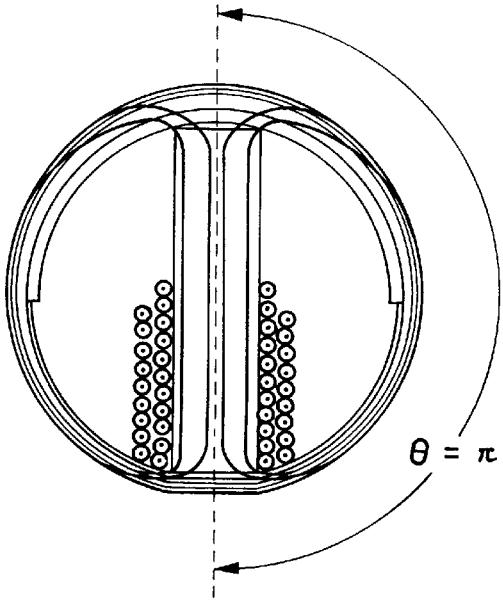

If the value of $\theta$ is $\pi$ (rad) as shown in FIG. 2C, the magnetic path becomes long, so as to decrease the magnetic flux density, which makes it difficult to achieve a quick temperature rise and which increases the losses due to radiation to the unignorable level because of an increase of the heating region. Such tendency becomes milder when the value of $\theta$ is set to be smaller than $5\pi/6$ (rad), thus achieving further better structure.

The present embodiment was constructed as selecting $\theta$ based on such results.

Namely, $\theta$ [rad] is defined as $0<\theta<\pi$; preferably, $\pi/6<\theta<5\pi/6$.

Figure 5:
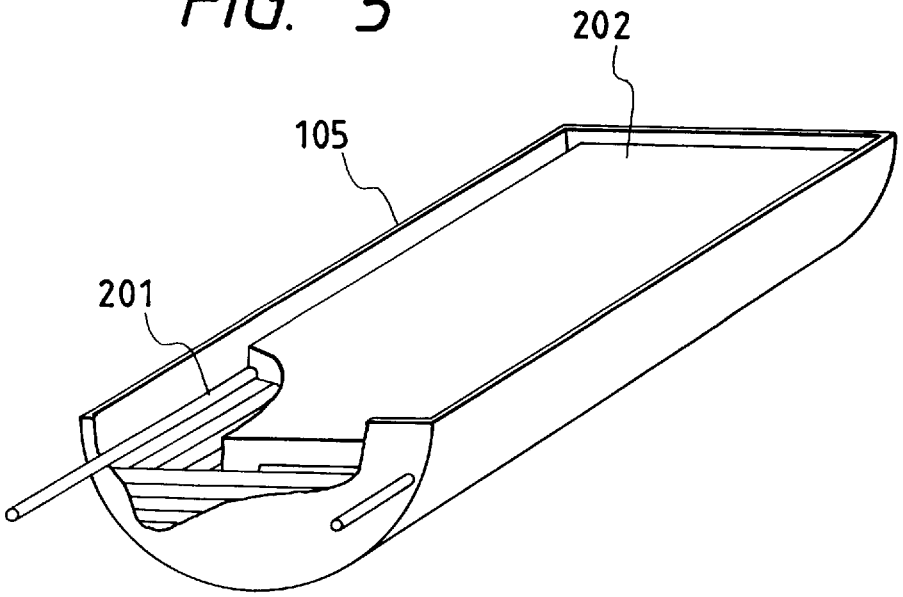
FIG. 5 is a perspective view of a part of the fixing apparatus.

FIG. 5 is a perspective view of the core (partly broken) 202, the exciting coil 201, and the film guide (the lower half) 105 shown in FIG. 1, and these members extend in the direction perpendicular to the moving direction of the fixing film.

The exciting coil 201 is mounted along the internal surface of the film guide 105 around the first portion 202*a* (see FIG. 2A) of the core 202, and is wound from the longitudinal end to the other end of core 202.

The longitudinal length of these core 202, exciting coil 201, and film guide 105 is correspondent to the width of a recording medium having the maximum size to be used.

Next described is the operational effect of an example where the image heating apparatus of the present embodiment is employed as a fixing device of a four-color image forming apparatus, together with the operation of the image forming apparatus.

Figure 6:
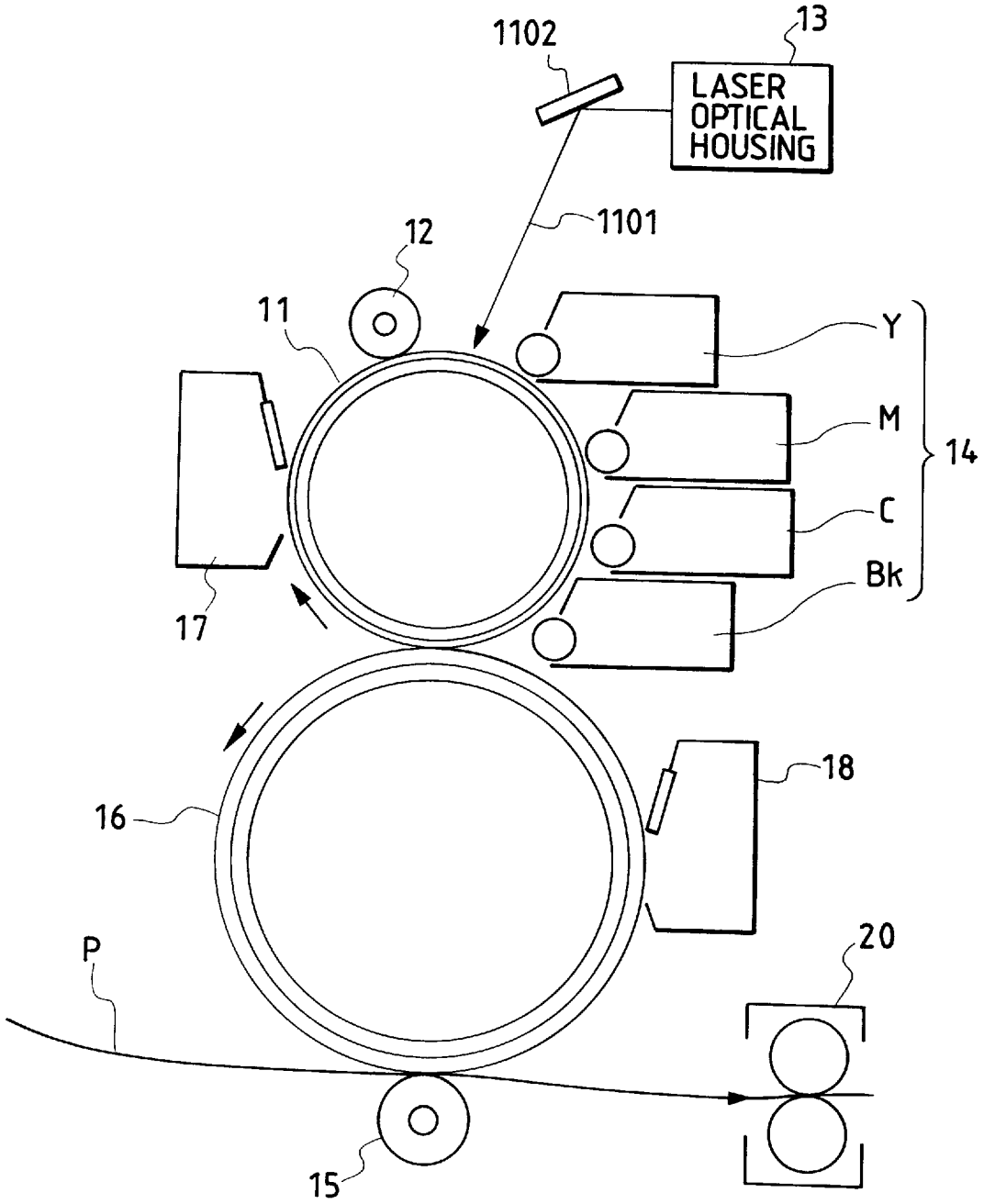
FIG. 6 is a schematic drawing of a color image forming apparatus to which the fixing apparatus of the present invention is applied.

FIG. 6 is a sectional view of an electrophotographic color printer to which the present invention is applied. Numeral 11 designates a photosensitive drum made of an organic photosensitive member, 12 a charging device for uniformly charging the photosensitive drum 11, and 13 a laser optical housing for forming an electrostatic latent image on the photosensitive drum 11 as converting signals from an image signal generator not shown into on/off of laser light. Numeral 1101 is the laser light, and 1102 a mirror. The electrostatic latent image on the photosensitive drum 11 is developed by selectively depositing the toner thereon by a developing unit 14. The developing unit 14 is comprised of color developers of yellow Y, magenta M, and cyan C and a developer B for black, by which the latent image is developed color by color on the photosensitive drum 11 to obtain a color image as successively superimposing the toner images on an intermediate transfer drum 16. The intermediate transfer drum 16 has an elastic layer of middle resistance and a surface layer of high resistance on a metal drum, and a bias potential is applied to the metal drum so as to transfer the toner image by a potential difference from the photosensitive drum 11. On the other hand, the recording medium P fed out from a sheet cassette by a feed roller is fed to between a transfer roller 15 and the intermediate transfer roller 16 in synchronization with the electrostatic latent image on the photosensitive drum 11. The transfer roller 15 supplies a charge of the opposite polarity to that of the toner from the back of the recording medium P, thereby transferring the toner image on the intermediate transfer drum 16 onto the recording medium P. Then the heat fixing apparatus 20 applies the heat and pressure to the recording medium P carrying the unfixed toner image, so as to permanently fix the image on the recording medium P. Then the recording medium is delivered onto a delivery tray (not shown). The toner and paper powder remaining on the photosensitive drum 11 is removed by a cleaner 17 and the toner and paper powder remaining on the intermediate transfer drum 16 is removed by a cleaner 18. The photosensitive drum 11 repeats the steps of and after charging.

The fixing device 20 employed is the image heating apparatus as discussed above, and the recording medium P is heated in the nip to fix the toner image and then is separated at the exit of the nip.

Figure 7:
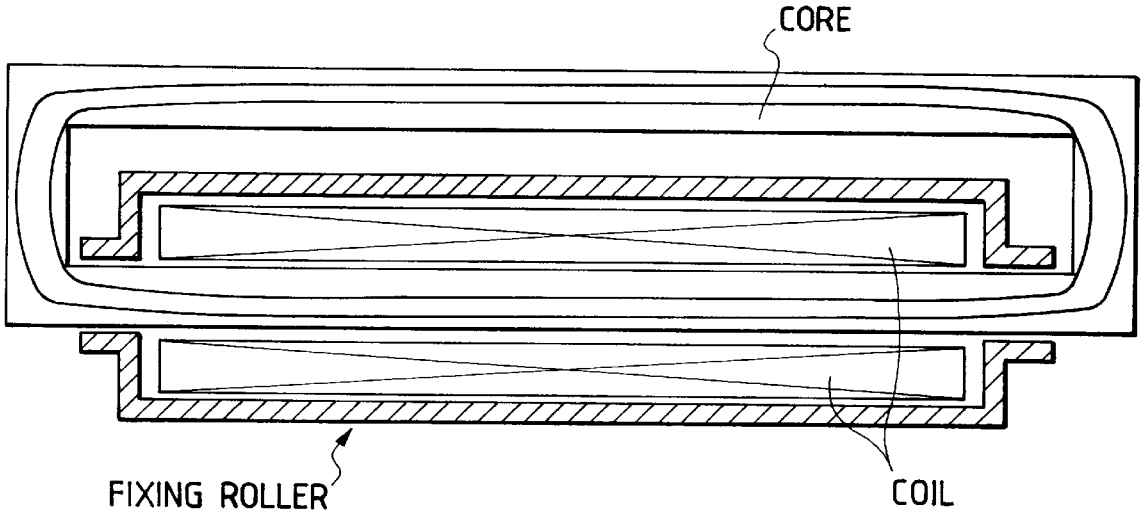
FIG. 7 PRIOR ART
FIG. 7 is a schematic sectional view of the conventional fixing apparatus.

When the above structure was compared with the image forming apparatus using the conventional image heating apparatus for heating the entire fixing roller as shown in FIG. 7, the above structure was able to curtail the wait time by 60 or more seconds and to improve the consumption power during printing by 20 or more %.

According to the present embodiment as described above, the high-permeability member adjusts the range and density of the magnetic flux passing the rotary heating member so as to enhance the energy conversion efficiency, and it decreases the radiation losses by specifically defining the heating portion, so as to raise the ratio of energy contributing to the fixing step.

Figure 8:
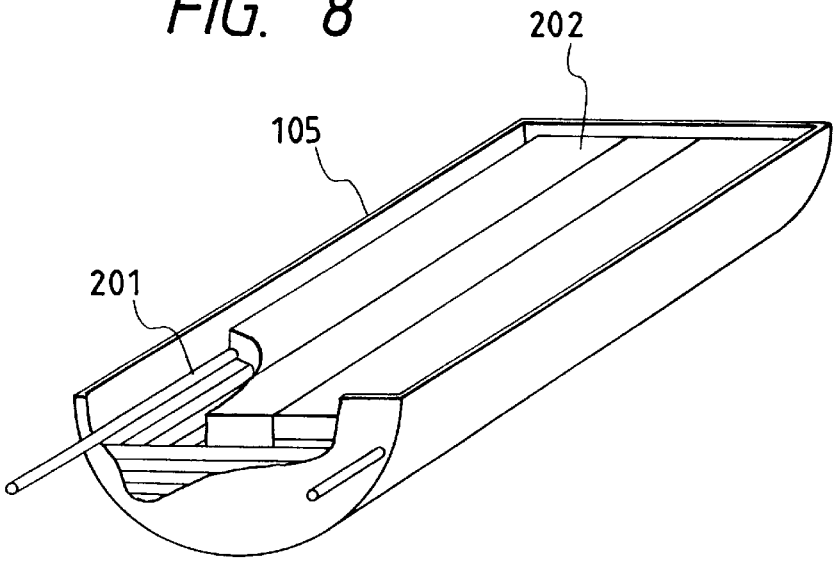
FIG. 8 is a perspective view of a part of a fixing apparatus in split core arrangement.

In the present embodiment the core 202 may be constructed of a combination of small blocks, for example, rectangular parallelepipeds, as shown in FIG. 8. In this case, the structure is flexible to strain or thermal strain against strong pressing force, whereby the core can be prevented from breaking. Further, a core of a complex configuration can be formed at low cost.

The four-color image forming apparatus was explained in the present embodiment, but the present invention can be applied to monochromatic or one-path multi-color image forming apparatus. In this case the elastic layer 102 can be omitted in the fixing film 1.

(Second Embodiment)

Figure 9:
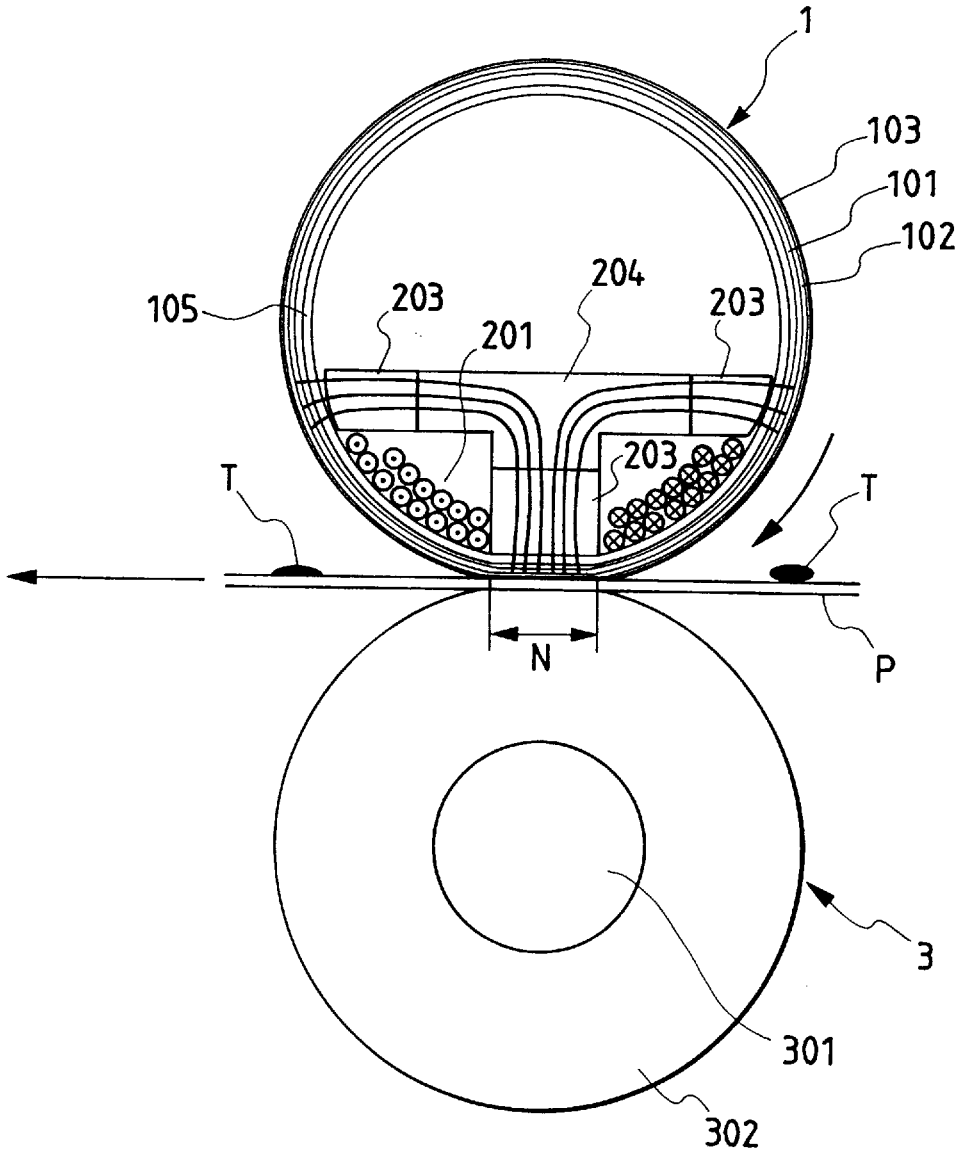
FIG. 9 is a sectional view of a fixing apparatus as another embodiment of the present invention.

FIG. 9 is a schematic sectional view to show another embodiment according to the present invention, and in the drawing the same reference numerals denote the same members as those explained above.

The present embodiment employs the small block arrangement as to the core 202 in the foregoing first embodiment, in which portions 203 faced to the fixing film 1 are made of a magnetic material having a high Curie temperature while a portion 204 apart from the fixing film 1 is made of a magnetic material having a relatively low Curie temperature but a high permeability. Normally available materials as such magnetic materials include magnetite for the former and manganese ferrite for the latter.

This arrangement has the advantages that even if the heat generated by the fixing film 1 is transferred to the core, the core does not lose magnetism to achieve good induction heating and that the strong magnetic flux is obtained by the magnetic material with high permeability in the portion 204 relatively less affected by the heat.

Namely, the present embodiment is arranged in such a manner that the high-permeability member is made of a combination of the magnetic materials of different Curie points, which permits the magnetic materials to be selected depending upon a temperature distribution, thereby enabling to prevent the permeability from dropping.

Since the present invention is characterized in that the core is constructed so as to form the closed magnetic circuit with the fixing film 1, the core needs to have the portions facing the fixing film 1 of high temperature. Thus, the present embodiment provides an improvement in the property against the temperature rise of the core 203 in this case.

(Third Embodiment)

Figure 10:
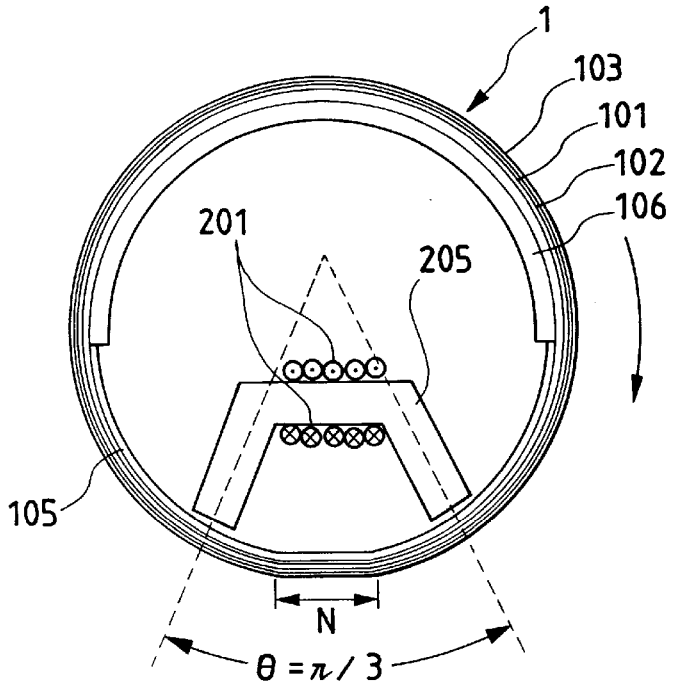
FIG. 10 is a sectional view of a fixing apparatus as still another embodiment of the present invention.

FIG. 10 is a schematic sectional view to show another embodiment according to the present invention, and in the drawing the same reference numerals denote the same members as those described above. Numeral 106 denotes an upper portion of the film guide divided.

The present embodiment employs a bipolar core 205 to concentrate the magnetic flux in a desired portion. In the present embodiment $\pi/3$ is selected for the angle $\theta$ of lines of magnetic force going into and out of the core 205. Since in this case the heating region is the region near the nip N and before and after the nip N, the most of the energy due to induction heating is consumed in the fixing step, whereby the consumption power can be decreased.

Figure 11:
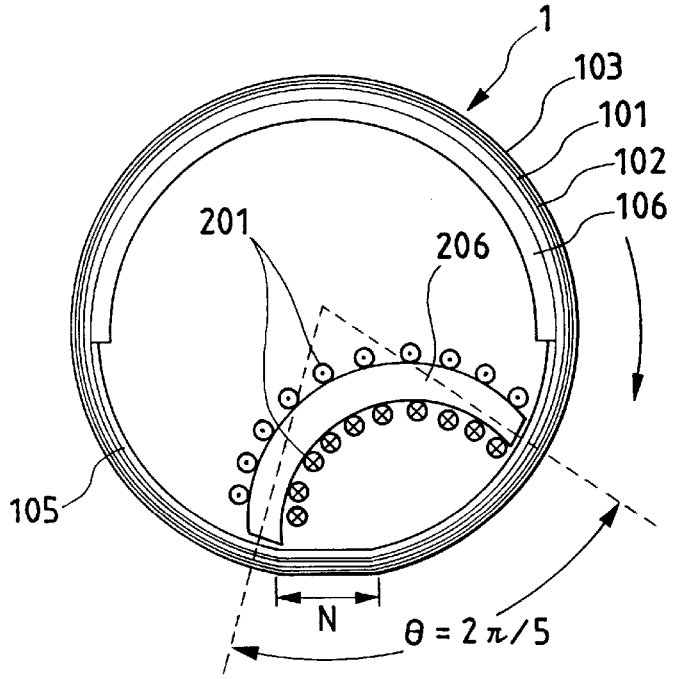
FIG. 11 is a sectional view of a fixing apparatus as still another embodiment of the present invention.
Figure 12:
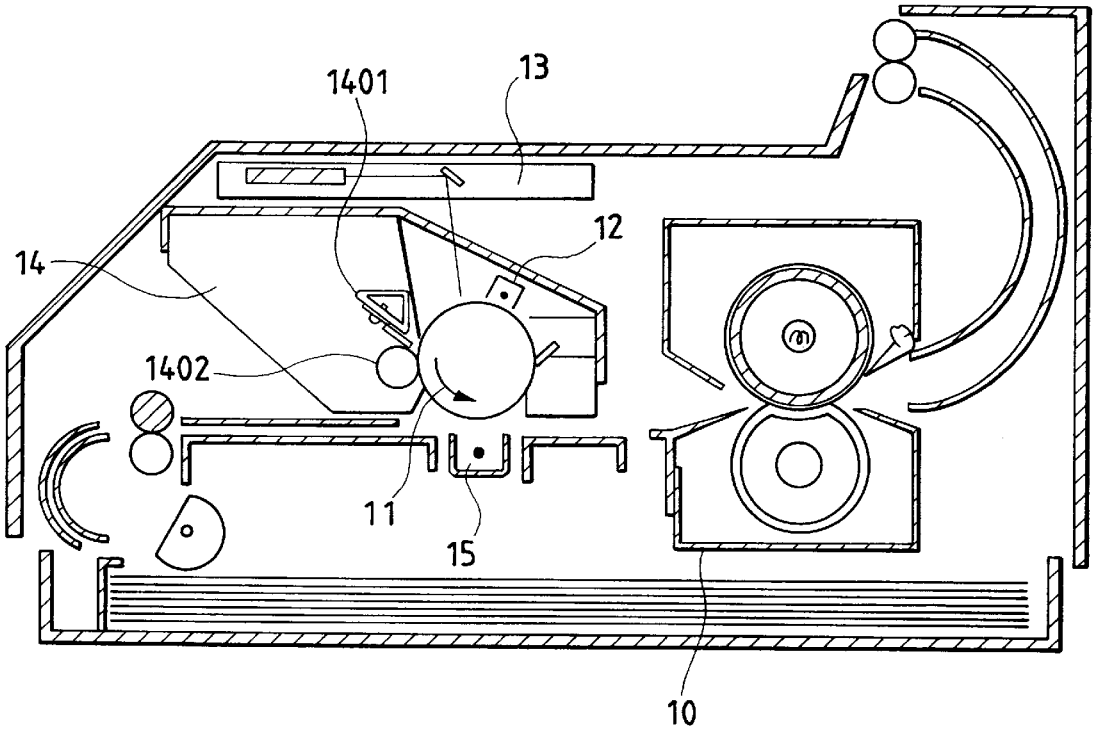
FIG. 12 PRIOR ART
FIG. 12 is a drawing to show a conventional image forming apparatus.

FIG. 11 shows a developed example of the present embodiment with $\theta=2\pi/5$. The core 206 has strong curvature as being convex toward the rotation center of the fixing film, whereby sufficient permeability can be attained even with a thin material. In addition, the center of the heating portion is shifted to the upstream side of the nip N with respect to the rotation direction of the fixing film 1, whereby the heat is transferred surely to the recording medium by movement of the fixing film 1 with rotation.

This arrangement allows cooling separation of the recording medium, which can prevent occurrence of separation failure, toner soil, or the like.

Since the present embodiment can supply the high magnetic flux to the fixing film 1, it is suitable for use of rather thick fixing film.

The embodiments of the present invention were explained above, but it is noted that the present invention is by no means limited to the above embodiments, but may have various arrangements and modifications within the technical idea of the present invention.

What is claimed is:

1. An image heating apparatus comprising:

a rotational member having an electrically conductive layer;

an exciting coil for generating a magnetic flux, wherein the magnetic flux generated by said exciting coil generates eddy currents in said rotational member to make said rotational member generate heat, and an image on a recording medium being heated by the heat of said rotational member;

a magnetic member for guiding the magnetic flux generated by said exciting coil, wherein said magnetic member is provided inside of said rotational member to form a substantially closed magnetic circuit, wherein an angle $\theta$ (rad) formed between a principle line of magnetic force directed from said magnetic member to said rotational member and a principle line of magnetic force directed from said rotational member to said magnetic member is determined to be $0<\theta<\pi$, and wherein said magnetic member is provided in a half region of said rotational member.

2. An image heating apparatus according to claim 1, further comprising a half cylindrical guide member provided inside of said rotational member for guiding movement of said rotational member, wherein said magnetic member is received in said guide member.

3. An image heating apparatus according to claim 2, wherein said exciting coil is received in said guide member.

4. An image heating apparatus according to claim 1, wherein said magnetic member has a first magnetic portion and a second magnetic portion through which each of said principle lines of magnetic force goes respectively.

5. An image heating apparatus according to claim 4, wherein an end portion of each of said first magnetic portion and said second magnetic portion is adjacent to said rotational member.

6. An image heating apparatus according to claim 4, wherein said second magnetic portion is provided upstream and downstream of said first magnetic portion with respect to a moving direction of said rotational member.

7. An image heating apparatus according to claim 6, wherein said exciting coil is wound around said first magnetic portion.

8. An image heating apparatus according to claim 4, further comprising a back-up member for forming a nip together with said rotational member, wherein an end of said first magnetic portion is opposed to said nip.

9. An image heating apparatus according to claim 1, wherein $\theta$ satisfies the relation $\pi/6<\theta<5\pi/6$.

10. An image heating apparatus according to claim 1, wherein $\theta$ is $\pi/2$.

11. An image heating apparatus according to claim 1, wherein said magnetic member is elongated in a direction perpendicular to a moving direction of said rotational member and said exciting coil is wound over a longitudinal direction of said magnetic member.

12. An image heating apparatus according to claim 1, wherein said rotational member is an endless film.

13. An image heating apparatus according to claim 1, further comprising a back-up member to form a nip together with said rotational member, wherein a recording medium which bears an unfixed toner image is nipped and conveyed at said nip to fix the unfixed toner image on the recording medium.

14. An image heating apparatus according to claim 1, wherein said principle line of magnetic force directed from said magnetic member to said rotational member of said principle line of magnetic force directed from said rotational member to said magnetic member occur at the same time.

15. An image heating apparatus comprising:

a rotational member having an electrically conductive layer;

an exciting coil for generating a magnetic flux, wherein the magnetic flux generated by said exciting coil generates eddy currents in said rotational member and the eddy currents make said rotational member generate heat;

a back-up member for forming a nip together with said rotational member, wherein a recording medium which bears an image is nipped and conveyed at said nip, the image on the recording medium being heated by the heat of said rotational member; and a magnetic member for guiding the magnetic flux generated by said exciting coil, wherein said magnetic member is provided inside of said rotational member, said rotational member and said magnetic member form a substantially closed magnetic circuit, an angle θ (rad) formed between a principle line of magnetic force directed from said magnetic member to said rotational member and a principle line of magnetic force directed from said rotational member to said magnetic member is determined to be $0<\theta<\pi$, and a central portion of a heat region of said rotational member generated by said closed magnetic circuit is located upstream of said nip with respect to a moving direction of said rotational member.

16. An image heating apparatus according to claim 15, wherein said magnetic member has a first magnetic portion and a second magnetic portion each of which said principle line of magnetic force goes through respectively, wherein said first magnetic portion, said second magnetic portion and said rotational member form a closed magnetic circuit.

17. An image heating apparatus according to claim 16, wherein said first magnetic portion is opposed to said nip.

18. An image heating apparatus according to claim 16, wherein said second magnetic portion is provided upstream and downstream of said first magnetic portion with respect to moving direction of said rotational member.

19. An image heating apparatus according to claim 18, wherein said exciting coil is wound around said first magnetic portion.

20. An image heating apparatus according to claim 15, wherein θ is preferably $\pi/6<\theta<5\pi/6$.

21. An image heating apparatus according to claim 15, wherein θ is $\pi/2$.

22. An image heating apparatus according to claim 15, wherein said magnetic member is provided in the half region of said rotational member.

23. An image heating apparatus according to claim 22, further comprising a half cylindrical guide member provided inside of said rotational member for guiding movement of said rotational member, wherein said magnetic member is received in said guide member.

24. An image heating apparatus according to claim 23, wherein said exciting coil is received in said guide member.

25. An image heating apparatus according to claim 15, wherein said magnetic member is elongated in a direction perpendicular to a moving direction of said rotational member and said exciting coil is wound over a longitudinal direction of said magnetic member.

26. An image heating apparatus according to claim 15, wherein said rotational member is an endless film.

27. An image heating apparatus according to claim 15, wherein a recording medium which bears an unfixed toner image is nipped and conveyed at said nip to fix the unfixed toner image on the recording medium.

28. An image heating apparatus according to claim 15, wherein said principle line of magnetic force directed from said magnetic member to said rotational member and said principle line of magnetic force directed from said rotational member to said magnetic member occur at the same time.

29. An image heating apparatus comprising:

a rotational member having an electrically conductive layer;

an exciting coil for generating a magnetic flux, wherein the magnetic flux generated by said exciting coil generates eddy currents in said rotational member and the eddy currents make said rotational member generate heat, and an image on a recording medium being heated by the heat of said rotational member; and a magnetic member provided inside of said rotational member for guiding the magnetic flux generated by said exciting coil, wherein said magnetic member has a first magnetic portion and a second magnetic portion which is provided in a direction substantially perpendicular to said first magnetic portion, said first magnetic portion and said second magnetic portion are provided in the half region of said rotational member.

30. An image heating apparatus according to claim 29, further comprising a half cylindrical guide member provided inside of said rotational member for guiding movement of said rotational member, wherein said magnetic member is received in said guide member.

31. An image heating apparatus according to claim 30, wherein said exciting coil is received in said guide member.

32. An image heating apparatus according to claim 29, further comprising a back-up member for forming a nip together with said rotational member, wherein said first magnetic portion and said second magnetic portion are provided in the half region on the side of said nip of said rotational member.

33. An image heating apparatus according to claim 32, wherein said first magnetic portion is opposed to said nip.

34. An image heating apparatus according to claim 33, wherein said second magnetic portion is positioned at the first end of the first magnetic portion opposite to a second end facing to said nip.

35. An image heating apparatus according to claim 29, wherein said second magnetic portion is provided upstream and downstream of said first magnetic portion with respect to a moving direction of said rotational member.

36. An image heating apparatus according to claim 35, wherein said exciting coil is wound around said first magnetic portion.

37. An image heating apparatus according to claim 29, wherein ends of said first magnetic portion and said second magnetic portion are adjacent to said rotational member.

38. An image heating apparatus according to claim 29, wherein said rotational member, said first magnetic portion and said second magnetic portion form a substantially closed magnetic circuit.

39. An image heating apparatus according to claim 38, further comprising a back-up member for forming a nip together with said rotational member, wherein a central portion of a heat region of said rotational member generated by said closed magnetic circuit is located upstream of said nip with respect to a moving direction of said rotational member.

40. An image heating apparatus according to claim 29, wherein said magnetic member is of a T-shaped form when seen with respect to a direction perpendicular to a moving direction of said rotational member.

41. An image heating apparatus according to claim 29, wherein said magnetic member is elongated in a direction perpendicular to a moving direction of said rotational member and said exciting coil is wound over a longitudinal direction of said magnetic member.

42. An image heating apparatus according to claim 29, wherein said rotational member is an endless film.

43. An image heating apparatus according to claim 29, further comprising a back-up member for forming a nip together with said rotational member, wherein a recording medium which bears an unfixed toner image is nipped and conveyed at said nip to fix the unfixed toner image on the recording medium.

44. An image heating apparatus comprising:

a rotational member having an electrically conductive layer;

an exciting coil for generating a magnetic flux, wherein the magnetic flux generated by said exciting coil generates eddy currents in said rotational member and the eddy currents make said rotational member generate heat, and an image on a recording medium is heated by the heat of said rotational member; and a magnetic member provided inside of said rotational member for guiding the magnetic flux generated by said exciting coil, wherein said magnetic member has a first magnetic portion and a second magnetic portion which is provided in a direction substantially perpendicular to said first magnetic portion, and said first magnetic portion and said second magnetic portion are rectangular parallelepiped, and both are independent of each other.

45. An image heating apparatus according to claim 44, further comprising a back-up member for forming a nip together with said rotational member, wherein the end of said first magnetic portion is opposed to said nip.

46. An image heating apparatus according to claim 45, wherein said second magnetic portion is positioned at a first end of said first magnetic portion opposite to the second end facing to said nip.

47. An image heating apparatus according to claim 44, wherein said second magnetic portion is provided upstream and downstream of said first magnetic portion with respect to a moving direction of said rotational member.

48. An image heating apparatus according to claim 47, wherein said exciting coil is wound around said first magnetic portion.

49. An image heating apparatus according to claim 44, wherein end portions of said first magnetic portion and said second magnetic portion are adjacent to said rotational member.

50. An image heating apparatus according to claim 44, wherein said rotational member, said first magnetic portion and said second magnetic portion substantially form a closed magnetic circuit.

51. An image heating apparatus according to claim 50, further comprising a back-up member for forming a nip together with said rotational member, wherein a central portion of a heat region of said rotational member generated by said closed magnetic circuit is located upstream of said nip with respect to a moving direction of said rotational member.

52. An image heating apparatus according to claim 44, wherein said magnetic member is of a T-shaped form when seen with respect to a direction perpendicular to a moving direction of said rotational member.

53. An image heating apparatus according to claim 44, wherein said first magnetic portion and said second magnetic portion are provided in the half region of said rotational member.

54. An image heating apparatus according to claim 53, further comprising a half cylindrical guide member provided inside of said rotational member for guiding movement of said rotational member, wherein said magnetic member is received in said guide member.

55. An image heating apparatus according to claim 53, further comprising a back-up member for forming a nip together with said rotational member, said first magnetic portion and said second magnetic portion are provided in the half region on the side of said nip of said rotational member.

56. An image heating apparatus according to claim 44, wherein said magnetic member is elongated in a direction perpendicular to a moving direction of said rotational member and said exciting coil is wound over a longitudinal direction of said magnetic member.

57. An image heating apparatus according to claim 44, wherein said rotational member is an endless film.

58. An image heating apparatus according to claim 44, further comprising a back-up member for forming a nip together with said rotational member, wherein a recording medium which bears an unfixed toner image is nipped and conveyed at said nip to fix the unfixed toner image on the recording medium.

* * * * *

UNITED STATES PATENT AND TRADEMARK OFFICE

CERTIFICATE OF CORRECTION

PATENT NO. : 5,881,349

DATED : March 9, 1999

INVENTOR(S) : HIDEO NANATAKI, ET AL.

It is certified that error appears in the above-indentified patent and that said Letters Patent is hereby corrected as shown below:

COLUMN 4,
Line 34, "resin based" should read --resin-based--.

COLUMN 6,
Line 12, "not shown" should read --(not shown)--.

COLUMN 7,
Line 48, "the most" should read --most--.

COLUMN 9,
Line 7, "of" should read --and--; and
Line 50, "moving" should read --a moving--.

COLUMN 11,
Line 47, "parallelepiped," should read --parallelepipeds,--.

Signed and Sealed this

Twenty-sixth Day of October, 1999

*Attest:*

Q. TODD DICKINSON

*Attesting Officer*

*Acting Commissioner of Patents and Trademarks*